United States Patent [19]
Reinhold

[11] 4,381,203
[45] Apr. 26, 1983

[54] COATING SOLUTIONS FOR ZINC SURFACES

[75] Inventor: Earl R. Reinhold, Levittown, Pa.

[73] Assignee: Amchem Products, Inc., Ambler, Pa.

[21] Appl. No.: 325,565

[22] Filed: Nov. 27, 1981

[51] Int. Cl.[3] ..... C23C 1/10
[52] U.S. Cl. ..... 148/6.14 R; 148/6.24
[58] Field of Search ..... 148/6.14 R, 6.24, 6

[56] References Cited

U.S. PATENT DOCUMENTS 3,444,007 5/1969 Maurer et al. ..... 148/6.15
3,515,600 6/1970 Jones ..... 148/6.15 R
3,929,514 12/1975 Houlihan ..... 148/6.14 R
4,278,477 7/1981 Reinhold ..... 148/6.15 R

*Primary Examiner*—Sam Silverberg
*Attorney, Agent, or Firm*—Ernest G. Szoke; Henry E. Millson, Jr.

[57] ABSTRACT

Solutions and processes for accelerating the rate of application of a conversion coating to zinc surfaces utilizing an aqueous solution containing an oxidizing agent which is a bromate, nitrite, persulfate or hypochlorite; a cation of cobalt, nickel, iron or tin; a complexing agent to keep the cation in solution; and sufficient alkaline material to produce a pH of at least 10.5.

32 Claims, No Drawings

COATING SOLUTIONS FOR ZINC SURFACES

BACKGROUND OF THE INVENTION

The application of conversion coatings on zinc surfaces prior to the application of a siccative film is well known in the industry. It is also known that a conversion coating can be applied to zinc surfaces from an alkaline solution due to the amphoteric properties of zinc metal.

U.S. Pat. No. 3,444,007, issued May 13, 1969 to James I Maurer et al. describes a process for applying a conversion coating to zinc surfaces using an alkaline solution of a metal ion other than an alkali metal ion, and a complexing agent to hold the metal ion in solution.

DESCRIPTION OF THE INVENTION

Aqueous solutions have now been discovered that accelerate the rate of the conversion coating on zinc or zinc alloy surfaces. Hence, significant savings in time and cost are realized using the aqueous solutions of the invention by resulting in increased production rates and/or reductions in processing temperatures.

The solutions and processes of the present invention can be used with all types of zinc and zinc alloy surfaces, such as pure zinc, electroplated zinc and hot-dipped zinc or zinc alloys on substrates of iron or steel, such as galvanized steel, and the like.

The aqueous solutions of the invention contain the following ingredients:

(a) at least one of the following anions in a coating accelerating quantity, generally in the quantity specified below;
  (i) from about 0.01 to about 2.5, preferably about 0.2 to about 1.5, and most preferably about 0.25 to about 1.0 grams per liter of hypochlorate;
  (ii) from about 0.01 to about 18, preferably about 0.5 to about 12 grams per liter of persulfate ion;
  (iii) from about 0.01 to about 25, preferably about 1.0 to about 15 grams per liter of nitrite ion; and
  (iv) from about 0.1 to about 25, preferably about 1.0 to about 10 grams per liter of bromate ion.

The above anions are conveniently employed as the alkali metal, calcium, or ammonium salt. The alkali metal can be sodium, potassium or lithium. However, any cation that results in a water-soluble salt with the above anions, and which does not interfere with the process of the invention, can be utilized herein.

(b) at least about 0.01 grams per liter, preferably from about 0.2 to about 1.0 grams per liter, of a cation of cobalt, nickel, iron, or tin, or a mixture of two or more of such cations. Preferred is a mixture of cations of iron and cobalt. The cation can be present as a salt with any anion that provides solubility at the concentrations used in the aqueous solutions of the invention. Examples of anions that can be employed are the nitrate, chloride, sulfate, and acetate, with the nitrate preferred.

(c) a complexing agent present in amount sufficient to keep the cation or mixture of cations in (b) above in solution. Preferably, not more than about 10 grams per liter of complexing agent is present. In fact, there is no advantage in having complexing agent present in amounts greater than that required to maintain said cation(s) in solution. Any complexing agent that will maintain the metal cation(s) in solution can be employed. Examples of such complexing agents are nitrilotriacetic acid and its alkali metal salts; diethanolglycine; hydroxyethylenediamine triacetate; triethylenetriamine pentaacetic acid and its salts; sodium gluconate; cyanides; condensed phosphates; ammonia; dicarboxylic acids such as malonic and fumaric acid; amino acids such as glycine; hydroxycarboxylic acids such as citric, glyconic, lactic, etc.; hydroxyaldehydes such as acetyl acetone; polyhydroxyaliphatic compounds such as sorbitol and 1,2-ethanediol; phenolic carboxylic acids such as salicylic acid and phthalic acid; amine carboxylic acids, such as EDTA; polyamino acids such as diethanolaminomethane phosphate; salts of lower molecular weight lignosulfonic acids such as sodium lignosulfonate; etc.

(d) a sufficient quantity of an alkaline material to produce a pH of 10.5 or higher, preferably a pH of 12.0 or higher. The alkaline material can be an alkali metal hydroxide, e.g. sodium, potassium or lithium hydroxide; an alkali metal carbonate, such as sodium or potassium carbonate; or a tri-alkali metal phosphate, such as trisodium or tripotassium phosphate. The alkali metal hydroxides are preferred.

The above solutions are formed by adding a concentrated solution of the above components to a controlled quantity of water, or by adding the ingredients separately to form the solutions directly. When the ingredients are added separately, the metal cation is added first, followed by addition of the complexing agent, the alkaline material is added to give the desired pH, and then the anion set forth in (a) above is added.

Conveniently, concentrates of the ingredients can be formed, and can be used commercially for addition to controlled quantities of water to prepare the aqueous coating solutions of the invention. The concentrates can be formulated by mixing together the above ingredients, in the order specified for forming the solutions, and in such quantities that the solutions of the invention result upon controlled dilution of the concentrate. However, it is not recommended to form concentrates with hypochlorites, since hypochlorites tend to be unstable in such concentrated aqueous solutions.

The process of the invention is carried out by contacting the zinc or zinc alloy surface with an aqueous solution of the invention at a temperature of from about 60° to about 212° F., preferably from about 80° to about 120° F. Treatment times of from about 1 second to about 2 minutes, preferably from about 5 seconds to about 15 seconds, can be employed. Contacting the zinc surface with the solution can be carried out according to methods known to the art, e.g. spraying, dipping, brushing, etc.

The zinc surface so treated has a coating of at least one metal oxide which is highly adhesive, and which forms an excellent base for the application of a siccative coating.

The invention will be better understood by reference to the following examples, which are given for illustration purposes only, and are not meant to limit the invention.

EXAMPLE I

A sheet of galvanized steel (Armco T.R. HDG) was cleaned and an oxide conversion coating applied according to the following procedure:

1. A commercial aqueous cleaning solution concentrate (Ridoline 1089—Amchem Products, Inc.) was added to water at the rate of 5 grams per liter. The resulting solution was sprayed onto the surface of the galvanized steel at 150° F. for 15 seconds.
2. The galvanized steel was rinsed using a cold tap water spray for 5 seconds, and then dried.
3. The galvanized steel was then sprayed with a solution containing the following ingredients for 2 seconds at a temperature of 120° F.:

| Ingredient | Grams/Liter |
|---|---|
| NaOH | 30.0 |
| $Fe(NO_3)_3.9H_2O$ | 1.5 |
| $Co(NO_3)_2.6H_2O$ | 1.5 |
| Na gluconate | 1.5 |

4. The galvanized steel was then sprayed for 5 seconds with cold water and dried.

The edges of the coated galvanized steel sheet were coated with a layer of paraffin wax. A stream of 10% $HNO_3$ was then sprayed onto the surface of the galvanized steel sheet until the coating on the surface was dissolved. The nitric acid solution containing the dissolved coating was collected in a glass calibrated container, and distilled water added to the solution until the total volume reached 100 ml. The resulting solution was stirred and a sample removed and the cobalt content thereof determined by atomic absorption. The values obtained for cobalt content were converted mathematically to mg/ft$^2$ of cobalt in the coating on the surface of the sheet.

The above procedure was repeated four more times with identical galvanized steel sheets. 0.63 mg/ft$^2$ was the average of the five cobalt determinations. This example was used as a control.

EXAMPLES II & III

Sheets of galvanized steel (Armco T.R. HDG) were cleaned and treated according to the process of EXAMPLE I, except that the spray time in step 3 was 5 seconds for EXAMPLE II, and 10 seconds for EXAMPLE III.

The cobalt determinations (average of five runs) were 1.18 mg/ft$^2$ in EXAMPLE II, and 2.19 mg/ft$^2$ in EXAMPLE III.

These examples were also used as controls.

EXAMPLES IV–XV

Sheets of galvanized steel (Armco T.R. HDG) were cleaned and treated according to the process of EXAMPLE I, except that the various quantities of calcium hypochlorite given in Table I below were added to the solution set forth in step 3 of EXAMPLE I, and the spray times are as listed. The quantities added for each example, the spray times used, and the results obtained are given in Table I together with those of EXAMPLES I, II and III (controls) for ease of comparison.

TABLE I

| Example | Spray Time, Secs. | g/l $OCl^{\ominus}$* | Cobalt in Coating, mg/ft$^2$ |
|---|---|---|---|
| I | 2 | — | 0.63 |
| IV | 2 | 0.14 | 0.82 |
| V | 2 | 0.36 | 1.23 |
| VI | 2 | 0.72 | 0.77 |
| VII | 2 | 1.44 | 0.26 |
| II | 5 | — | 1.18 |

TABLE I-continued

| Example | Spray Time, Secs. | g/l $OCl^{\ominus}$* | Cobalt in Coating, mg/ft$^2$ |
|---|---|---|---|
| VIII | 5 | 0.14 | 1.39 |
| IX | 5 | 0.36 | 2.11 |
| X | 5 | 0.72 | 1.13 |
| XI | 5 | 1.44 | 0.31 |
| III | 10 | — | 2.19 |
| XII | 10 | 0.14 | 2.98 |
| XIII | 10 | 0.36 | 3.50 |
| XIV | 10 | 0.72 | 1.80 |
| XV | 10 | 1.44 | 0.41 |

*Added as $Ca(OCl)_2$

EXAMPLES XVI–XXVII

Sheets of galvanized steel (Armco T.R. HDG) were cleaned and treated according to the process of EXAMPLE I, except that the various quantities of lithium hypochlorite given in Table II below were added to the solution set forth in step 3 of EXAMPLE I, and the spray times are as listed. The quantities added for each example, the spray times used, and the results obtained are given in Table II together with those of EXAMPLES I, II and III (controls) for ease of comparison.

TABLE II

| Example | Spray Time, Secs. | g/l $OCl^{\ominus}$* | Cobalt in Coating, mg/ft$^2$ |
|---|---|---|---|
| I | 2 | — | 0.63 |
| XVI | 2 | 0.88 | 0.98 |
| XVII | 2 | 1.76 | 0.82 |
| XVIII | 2 | 4.41 | 0.36 |
| XIX | 2 | 8.81 | 0.21 |
| II | 5 | — | 1.18 |
| XX | 5 | 0.88 | 1.70 |
| XXI | 5 | 1.76 | 1.49 |
| XXII | 5 | 4.41 | 0.46 |
| XXIII | 5 | 8.81 | 0.15 |
| III | 10 | — | 2.19 |
| XXIV | 10 | 0.88 | 2.67 |
| XXV | 10 | 1.76 | 2.57 |
| XXVI | 10 | 4.41 | 0.77 |
| XXVII | 10 | 8.81 | 0.15 |

*Added as LiOCl

EXAMPLES XXVIII–XLII

Sheets of galvanized steel (Armco T.R. HDG) were cleaned and treated according to the process of EXAMPLE I, except that the various quantities of ammonium persulfate given in Table III below were added to the solution set forth in step 3 of EXAMPLE I, and the spray times are as listed. The quantities added for each example, the spray times used, and the results obtained are given in Table III together with those of EXAMPLES I, II and III (controls) for ease of comparison.

TABLE III

| Example | Spray Time, Secs. | g/l $S_2O_8^{\ominus}$* | Cobalt in Coating, mg/ft$^2$ |
|---|---|---|---|
| I | 2 | — | 0.63 |
| XXVIII | 2 | 0.84 | 0.98 |
| XXIX | 2 | 1.68 | 0.82 |
| XXX | 2 | 4.21 | 1.13 |
| XXXI | 2 | 8.42 | 1.23 |
| XXXII | 2 | 16.84 | 0.72 |
| II | 5 | — | 1.18 |
| XXXIII | 5 | 0.84 | 1.59 |
| XXXIV | 5 | 1.68 | 1.44 |
| XXXV | 5 | 4.21 | 1.80 |
| XXXVI | 5 | 8.42 | 1.75 |
| XXXVII | 5 | 16.84 | 0.51 |
| III | 10 | — | 2.19 |

TABLE III-continued

| Example | Spray Time, Secs. | g/l $S_2O_8$ * | Cobalt in Coating, mg/ft$^2$ |
|---|---|---|---|
| XXXVIII | 10 | 0.84 | 2.57 |
| XXXIX | 10 | 1.68 | 2.73 |
| XL | 10 | 4.21 | 3.03 |
| XLI | 10 | 8.42 | 3.45 |
| XLII | 10 | 16.84 | 1.85 |

*Added as $(NH_4)_2S_2O_8$

EXAMPLES XLIII-LVII

Sheets of galvanized steel (Armco T.R. HDG) were cleaned and treated according to the process of EXAMPLE I, except that the various quantities of sodium nitrite set forth in Table IV below were added to the solution set forth in step 3 of EXAMPLE I, and the spray times are as listed. The quantities added for each example, the spray times used, and the results obtained are given in Table IV together with those of EXAMPLES I, II and III (controls) for ease of comparison.

TABLE IV

| Example | Spray Time, Secs. | g/l $NO_2^{\ominus}$* | Cobalt in Coating, mg/ft$^2$ |
|---|---|---|---|
| I | 2 | — | 0.63 |
| XLIII | 2 | 0.67 | 0.72 |
| XLIV | 2 | 1.33 | 0.67 |
| XLV | 2 | 3.33 | 0.87 |
| XLVI | 2 | 6.67 | 0.98 |
| XLVII | 2 | 13.33 | 0.98 |
| II | 5 | — | 1.18 |
| XLVIII | 5 | 0.67 | 1.39 |
| XLIX | 5 | 1.33 | 1.44 |
| L | 5 | 3.33 | 1.49 |
| LI | 5 | 6.67 | 1.54 |
| LII | 5 | 13.33 | 1.75 |
| III | 10 | — | 2.19 |
| LIII | 10 | 0.67 | 2.47 |
| LIV | 10 | 1.33 | 2.78 |
| LV | 10 | 3.33 | 2.93 |
| LVI | 10 | 6.67 | 3.15 |

EXAMPLES LVIII-LXXII

Sheets of galvanized steel (Armco T.R. HDG) were cleaned and treated according to the process of EXAMPLE I, except that the various quantities of potassium bromate set forth in Table V below were added to the solution set forth in step 3 of EXAMPLE I, and the spray times are as listed. The quantities added for each example, the spray times used, and the results obtained are given in Table V together with those of EXAMPLES I, II and III (controls) for ease of comparison.

TABLE V

| Example | Spray Time, Secs. | g/l $BrO_3^{\ominus}$* | Cobalt in Coating, mg/ft$^2$ |
|---|---|---|---|
| I | 2 | — | 0.63 |
| LVIII | 2 | 0.76 | 0.98 |
| LIX | 2 | 1.53 | 1.08 |
| LX | 2 | 3.83 | 1.08 |
| LXI | 2 | 7.66 | 0.87 |
| LXII | 2 | 15.32 | 0.82 |
| II | 5 | — | 1.18 |
| LXIII | 5 | 0.76 | 1.49 |
| LXIV | 5 | 1.53 | 1.65 |
| LXV | 5 | 3.83 | 1.75 |
| LXVI | 5 | 7.66 | 1.54 |
| LXVII | 5 | 15.32 | 1.59 |
| III | 10 | — | 2.19 |
| LXVIII | 10 | 0.76 | 2.78 |
| LXIX | 10 | 1.53 | 3.09 |
| LXX | 10 | 3.83 | 3.03 |
| LXXI | 10 | 7.66 | 2.83 |
| LXXII | 10 | 15.32 | 2.37 |

*Added as $KBrO_3$

As can be seen from the above examples, the use of the solutions of the invention containing a quantity of oxidizing anion within the ranges determined as effective, produced significantly heavier coatings on the zinc surfaces than those formed on the controls (EXAMPLES I, II and III). It can also be seen from the above examples that in many instances the use of oxidizing anion in excess of the quantities found to be advantageous herein produced the opposite effect, i.e. resulted in less coating than that produced by the controls.

The conversion coatings formed by the solutions of the invention can be used as a base for siccative coatings that meet or exceed all industry standards for such siccative coatings.

What is claimed is:

1. An aqueous solution for applying a conversion coating to a zinc or zinc alloy surface consisting essentially of:
   (a) a coating accelerating quantity of at least one of the following anions—bromate, nitrite, persulfate, and hypochlorite;
   (b) at least about 0.01 grams per liter of at least one of the following metals in the form of a cation—cobalt, nickel, iron, and tin;
   (c) a complexing agent present in an amount sufficient to hold the cation in (b) above in solution; and
   (d) sufficient alkaline material to produce a pH of at least 10.5 in the solution.

2. An aqueous solution for applying a conversion coating to a zinc or zinc alloy surface consisting essentially of:
   (a) at least one of the following:
      (i) from about 0.01 to about 2.5 grams per liter of hypochlorite ion;
      (ii) from about 0.01 to about 18 grams per liter of persulfate ion;
      (iii) from about 0.01 to about 25 grams per liter of nitrite ion; and
      (iv) from about 0.01 to about 25 grams per liter of bromate ion;
   (b) at least about 0.01 grams per liter of at least one of the following metals in the form of a cation—cobalt, nickel, iron, and tin;
   (c) a complexing agent present in an amount sufficient to hold the cation in (b) above in solution; and
   (d) sufficient alkaline material to produce a pH of at least 10.5 in the solution.

3. The aqueous solution of claim 1 wherein the anion in (a) is from about 0.2 to about 1.5 grams per liter of hypochlorite.

4. The aqueous solution of claim 2 wherein the anion in (a) is from about 0.25 to about 1.0 grams per liter of hypochlorite.

5. The aqueous solution of claim 2 wherein the anion in (a) is from about 0.5 to about 12 grams per liter of persulfate.

6. The aqueous solution of claim 2 wherein the anion in (a) is from about 1.0 to about 15 grams per liter of nitrite.

7. The aqueous solution of claim 2 wherein the anion in (a) is from about 1.0 to about 10 grams per liter of bromate.

8. The aqueous solution of claim 2 wherein the anion in (a) is present as an alkali metal, calcium or ammonium salt.

9. The aqueous solution of claim 2 wherein the cation in (b) is present as the nitrate, chloride, sulfate or acetate salt.

10. The aqueous solution of claim 2 wherein the complexing agent in (c) is present in no more than about 10 grams per liter.

11. The aqueous solution of claim 2 wherein the complexing agent is sodium gluconate.

12. The aqueous solution of claim 2 wherein the alkaline material in (d) is an alkali metal hydroxide.

13. The aqueous solution of claim 2 wherein the alkaline material in (d) is an alkali metal carbonate.

14. The aqueous solution of claims 1, 2, 3, 4, 5, 6, 7, 8, 9, 10, 11, 12, or 13 wherein sufficient alkaline material in (d) is present to produce a pH of at least 12.0 in the solution.

15. An aqueous concentrate for use in forming a solution for applying a conversion coating to a zinc or zinc alloy surface consisting essentially of:

(a) one or more of the following anions—bromate, nitrite, and persulfate;

(b) one or more of the following metals in the form of a cation—cobalt, nickel, iron, and tin;

(c) a complexing agent to hold the cation in (b) in solution; and (d) an alkaline material; wherein the above ingredients are present in amount sufficient to produce a solution useful for applying a conversion coating to a zinc or zinc alloy surface upon the addition of the concentrate to a controlled quantity of water.

16. The aqueous concentrate of claim 15 wherein the alkaline material in (d) is present in amount sufficient to produce a solution having a pH of at least 12.0 when the concentrate is added to a controlled quantity of water.

17. A process for applying a conversion coating to a zinc or zinc alloy surface comprising the steps of:

(a) contacting the zinc or zinc alloy surface for from about 1 second to about 2 minutes at a temperature in the range of from about 60° to about 212° F. with an aqueous solution comprising;

(i) a coating accelerating quantity of at least one of the following anions—bromate, nitrite, persulfate, and hypochlorite;

(ii) at least about 0.01 grams per liter of at least one of the following metals in the form of a cation—cobalt, nickel, iron, and tin;

(iii) a complexing agent present in an amount sufficient to hold the cation in (b) above in solution; and (iv) sufficient alkaline material to produce a pH of at least 10.5 in the solution; and (b) removing excess solution from said surface.

18. The process of claim 17 wherein the pH of the solution is at least about 12.0.

19. The process of claim 17 wherein the treatment time is from about 5 seconds to about 15 seconds.

20. The process of claim 17 wherein the temperature is from about 80° to about 120° F.

21. The process of claim 17 wherein the excess solution is removed in step (b) by spraying or dipping in water.

22. The process of claim 17 wherein step (a) is carried out by spraying the solution onto said surface.

23. The process of claim 17, 18, 19, 20, 21, or 22 wherein the anion in (a) (i) is at least one of the following:

(a) from about 0.01 to about 2.5 grams per liter of hypochlorite;

(b) from about 0.01 to about 18 grams per liter of persulfate;

(c) from about 0.01 to about 25 grams per liter of nitrite; and (d) from about 0.01 to about 25 grams per liter of bromate.

24. The process of claim 23 wherein the alkaline material in (a) (iv) is an alkali metal hydroxide.

25. The aqueous solution of claim 23 wherein the alkaline material in (a) (iv) is an alkali metal carbonate.

26. The process of claim 23 wherein the anion is from about 0.2 to about 1.5 grams per liter of hypochlorite.

27. The process of claim 23 wherein the anion is from about 0.25 to about 1.0 grams per liter of hypochlorite.

28. The process of claim 23 wherein the anion is from about 0.5 to about 12 grams per liter of persulfate.

29. The process of claim 23 wherein the anion is from about 1.0 to about 15 grams per liter of nitrite.

30. The process of claim 23 wherein the anion is from about 1.0 to about 10 grams per liter of bromate.

31. The aqueous solution of claim 23 wherein the anion is present as an alkali metal, calcium or ammonium salt.

32. The process of claim 23 wherein the cation in (a) (ii) is present as the nitrate, chloride, sulfate or acetate salt.

* * * * *